US005396903A

United States Patent [19]

Pruitt

[11] Patent Number: 5,396,903

[45] Date of Patent: Mar. 14, 1995

[54] HEAD CUSHION AND DRAPE STAND

[76] Inventor: Ernest B. Pruitt, Rte. 6, Box 290, Mooresville, N.C. 28115

[21] Appl. No.: 204,949

[22] Filed: Mar. 2, 1994

[51] Int. Cl.[6] ..... A61G 15/00; A47C 20/02

[52] U.S. Cl. ..... 128/845; 5/636

[58] Field of Search ..... 16/225, DIG. 13; 128/845, 846, 869–876, 849; 5/636, 637

[56] References Cited

U.S. PATENT DOCUMENTS

| | | | |
|---|---|---|---|
| 1,257,332 | 2/1918 | Erlandson | 5/505.1 |
| 2,628,803 | 2/1953 | Krewson | 248/124 |
| 3,347,544 | 10/1967 | Uffenorde | 128/845 |
| 4,058,112 | 11/1977 | Johnson | 128/845 |
| 4,550,713 | 11/1985 | Hyman | 600/21 |
| 4,554,616 | 11/1985 | McIntosh | 16/DIG. 13 |
| 4,669,106 | 5/1987 | Ammerman | 128/870 |

FOREIGN PATENT DOCUMENTS

| | | | |
|---|---|---|---|
| 2096463 | 10/1982 | United Kingdom | 128/845 |

*Primary Examiner*—Michael A. Brown
*Attorney, Agent, or Firm*—Eugene E. Renz, Jr.

[57] ABSTRACT

A device for use with a patient on a medical procedure table or the like for locating a surgical drape, comprising a mobile head cushion and a drape stand. The head cushion is formed from a foam material. The cushion has a first surface for placement of the cushion on the table and an opposite surface having positioning for locating a patient's head in a predetermined location on the table. The cushion further is adapted to locate a drape stand with respect to the predetermined location. The drape stand for receiving the surgical drape is being formed from a plastic, hollow tube having two ends for cooperative engagement with the cushion and a length equal to about twice the desired height plus the width of the stand. The tube has two hinges formed by radially cutting partially through the periphery of the tube, each of the hinges being spaced from an end of the tube by the desired height and spaced from each other by the width.

5 Claims, 8 Drawing Sheets

HEAD CUSHION AND DRAPE STAND

FIELD OF THE INVENTION

The present invention relates to a device for use with a patient on an operating room table or other medical procedure table. More particularly, the present invention relates to a device for locating a surgical drape which employs a foam pillow like structure as a base for a head cushion and drape stand, using one piece of tube or pipe to define the drape stand portion.

BACKGROUND OF THE INVENTION

Oftentimes during surgery, it is necessary to cover a portion of the patient while procedures are carried out on a specific region of the patient. For example, open heart surgery may require an area of the torso to be exposed with the majority of the body and certainly all of the patient's head being protected by surgical drapes. Of course, it is not possible to merely cover the patient, without maintaining clear access to the patient's head, either for comfort or for the administration of medicines and the like.

Currently the positioning of a sterile drape proximate a patient's head during surgical or medical procedures is accomplished in one of three ways. One method is to use a Mayo stand that rests on the floor while the tray area is positioned over the patient's head. Alternatively, two IV poles can be placed on the floor behind the patent's head, with a sterile drape clipped to each pole to form a tent. The most secure and at the same time most expensive method is to attach a metal bar to the operating table with an involved metal clamp which crosses over the patient's head.

Early efforts to employ a surgical drape are shown in Erlandson U.S. Pat. No. 1,257,332, in which a basic frame structure used in surgery is disclosed. The frame is formed of metal and is mounted to a substrate such as an operating table. Krewson U.S. Pat. No. 2,628,803 describes another version of prior art drape stands, again without providing comfort to the patient and again being fabricated from metal and employing a plurality of parts.

Hyman U.S. Pat. No. 4,550,713 and Crook et al. U.S. Pat. No. 4,699,131 both relate to specific devices useful for eye surgery, particularly for positioning additional equipment on the operating table (Hyman) and randomly associated with the table but aligned with the patient (Crook et al). Winner U.S. Pat. No. 4,034,748 and Slagle U.S. Pat. No. 3,851,644 disclose devices for restraining or immobilizing a patient.

None of these methods is inexpensive, none offers particular comfort to the patient and none cooperatively locates the patient's head on the table to insure positioning of the sterile surgical drape in a particular relationship with the patient. None of the prior art provides a simple, easy to manufacture device for locating a surgery drape with respect to both the patient and the procedure table, using inexpensive materials that can be discarded or recycled if desired.

Accordingly, it is an object of the present invention to provide a simple, effective device for positioning a surgical drape proximate a patient.

Another object of this invention is to provide a device which is able to cooperatively locate the patient and the drape with respect to a medical procedure.

Other objects will appear hereinafter.

SUMMARY OF THE INVENTION

It has now been discovered that the above and other objects of the present invention may be accomplished in the following manner. Specifically, the present invention provides a device for use with a patient on a procedure table or other surface for locating a surgical drape, comprising a mobile head cushion and a drape stand.

The device takes only seconds to set up and moves with the procedure table. The head cushion, which is formed from a foam material, provides access to the patient from a variety of angles and is disposable, avoiding the need for cleaning and sterilization. The cushion or base is made from dense, light-weight foam, and has a first surface for placement of the cushion on the table and an opposite surface having positioning means for locating a patient's head in a predetermined location on the table. The cushion further is adapted to locate a drape stand with respect to the predetermined location.

The drape stand for receiving the surgical drape is formed from a single tube having two ends for cooperative engagement with the cushion. The tube length is equal to about twice the desired height plus the width of the stand. The tube has two hinges formed by radially cutting partially through the periphery of the tube, each of the hinges being spaced from an end of the tube by the desired height and spaced from each other by the width. The cuts in the periphery which form the hinges will normally be from about 70% to about 98% of the periphery, leaving sufficient pipe thickness to function as an effective and long lasting hinge. It has been found that these hinges are capable of flexing for long periods of time before showing signs of wear or weakening. Preferably the tube is hollow, although solid tubes are also effective in this invention.

The present invention is shown in two embodiments, illustrating a simple, inexpensive and compact version and also illustrating a more diverse, adaptable form for use in a larger variety of surgical and medical procedures.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
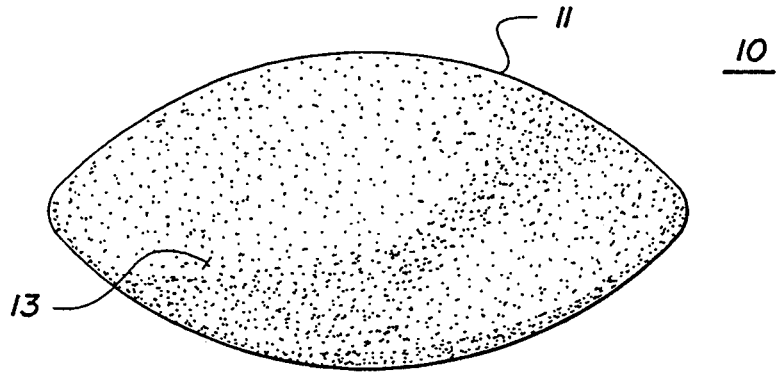
FIG. 1 is a bottom plan view of one embodiment of the present invention.

As shown in the drawings, a device generally at 10 includes a foam cushion 11, shown in bottom plan view in FIG. 1 to illustrate the bottom surface 13 which engages a procedure table as described below. Cushion 11 is preferably formed from urethane foam because of its superior properties. Other foams are also suitable, as well as cushions formed from other materials that are similar in function to foam pillows or cushions.

Particularly preferred is urethane foam manufactured by Barnhardt Manufacturing Co., and identified as 1644-CA Blue 110. This urethane foam has a density of about 1.60 and has a resiliency of 40 to 48, defined as percent rebound. Under static use, such as when employed in the present invention with a patient resting on the placement area, this cushion material has less than a 5% loss in thickness. This material does pass flammability tests such as California Technical Bulletin No. 117.

Figure 2:
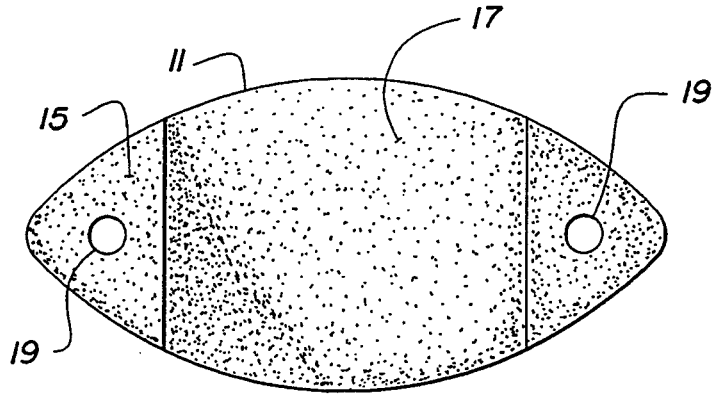
FIG. 2 is a top plan view of the device of FIG. 1.
Figure 3:
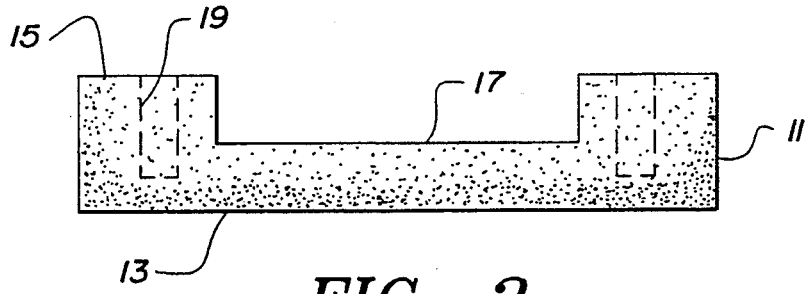
FIG. 3 is a front elevational view of the device of FIG. 1.
Figure 4:
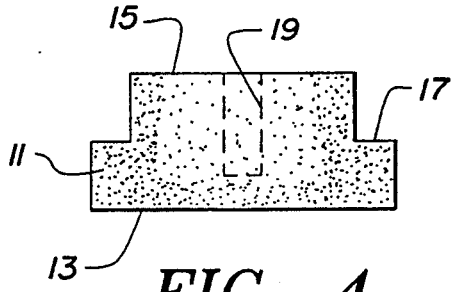
FIG. 4 is a side elevational view of the device of FIG. 1.
Figure 5:
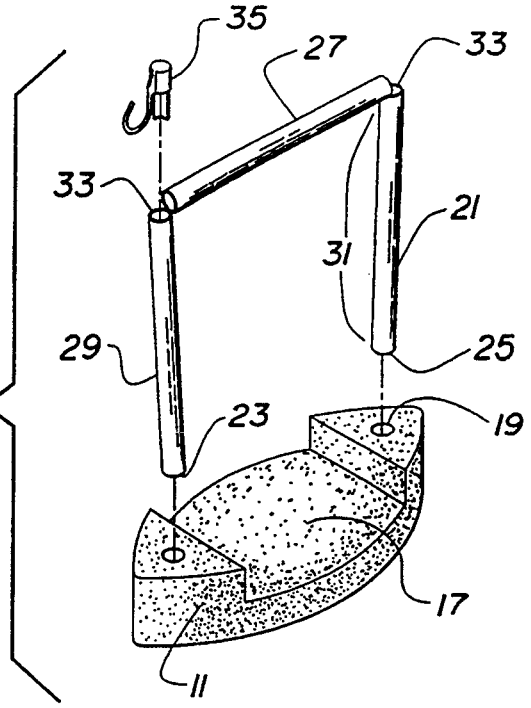
FIG. 5 is a perspective view of the device of FIG. 1, shown exploded for clarity.
Figure 6:
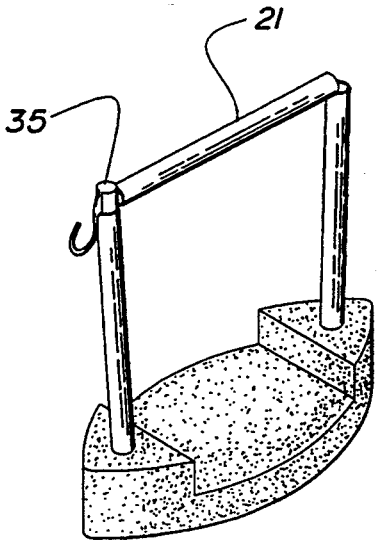
FIG. 6 is a perspective view of the device of FIG. 5, shown in an assembled configuration.

FIG. 2 illustrates the top of cushion 11, showing the upper surface 15 having a portion 17 for engagement with a patient and having holes 19 for locating a frame for the surgical drape. Holes 19 are spaced apart sufficiently to locate the pipe 21, as seen in FIGS. 5 and 6, so that patient engaging surface 17 can comfortably accommodate a patient and sterile surgical drape.

Pipe 21 is designed such that its ends 23 and 25 can be placed in holes 19. The distance between holes 19 is approximately equal to the width portion 27 of tube 21. The height that width portion 27 extends above patient engaging surface 17 is defined by lengths 29 and 31, which extend respectively from ends 23 and 25 to the location of cuts 33 which form hinges. Preferably, cuts 33 formed by cutting from about 70% to about 98% of the periphery of pipe 21. Pipe or tube 21 is preferably formed from high density, high molecular weight polyethylene pipe that has long term flexibility without breaking. One such material is Poly Pipe PE 3408, manufactured by Silverline Plastics Corporation of Asheville, N.C. The preferred material, Poly Pipe PE 3408, is made from a high density, high molecular weight resin that is classified as a Type III, Grade P34, Class C, Catagory 5, by ASTM D1248. Its cell classification by ASTM D3350 is 345434C and it has been rated as PE3408 by the Plastic Pipe Institute, a division of the Society of the Plastics Industry, Inc. Density is nominally 0.955 mgs/cc and has a Shore D hardness of 66. An important property is the flexural modulus, which has a nominal value of 136,000 psi and the long term modulus of elasticity of 30,000 psi. Hinges formed by cutting the periphery of the pipe have been found to last virtually indefinitely. Solid tubes may also be formed from this plastic or others for use in the present invention.

Figure 7:
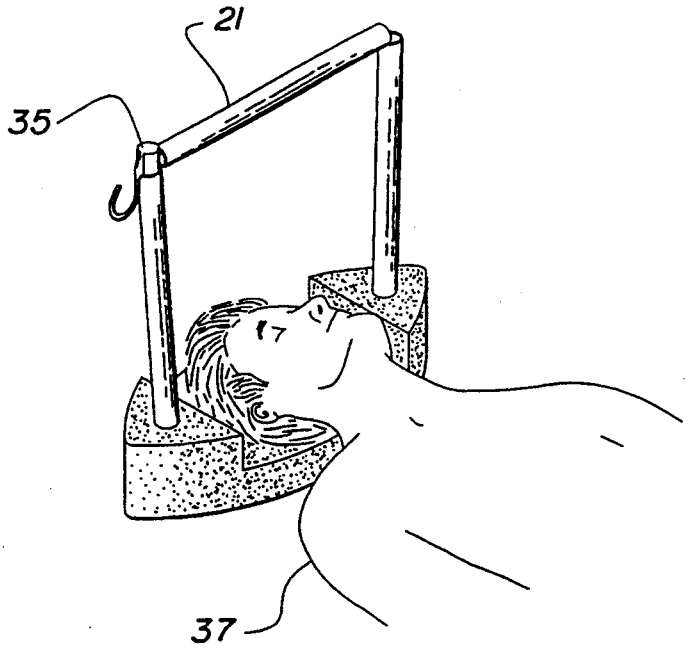
FIG. 7 is a perspective view showing the device of FIG. 5 in combination with a patient.
Figure 8:
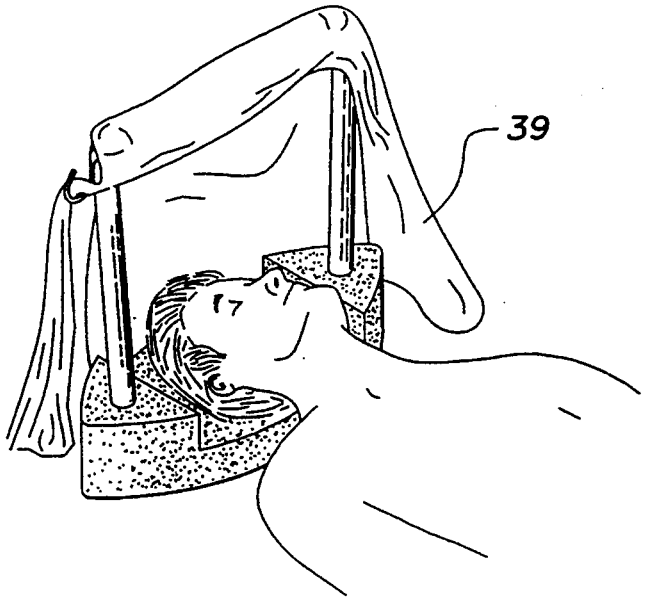
FIG. 8 is a view similar to FIG. 5, with the addition of a surgery drape partially covering the patient.
Figure 11:
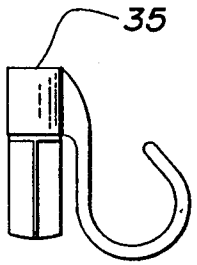
FIG. 11 is an enlarged, perspective view of a hook used to engage the surgical drape, shown also in FIGS. 7 and 8.

Assembly of the device of this invention is easy. As shown in FIG. 5, the ends 23 and 25 fit into holes 19 as the pipe 21 has been bent to the desired orientation using hinges 33 formed from cuts 33 as shown. A hook 35, shown being inserted in FIG. 5 and in position in FIG. 6 is provided to engage the sterile surgery drape as shown in FIG. 8 after the patient 37 is in position as shown in FIG. 7. Drape 39 can be adjusted as needed. Pipe 21 and hook 35 are shown in larger detail in FIGS. 9, 10 and 11.

Figure 18:
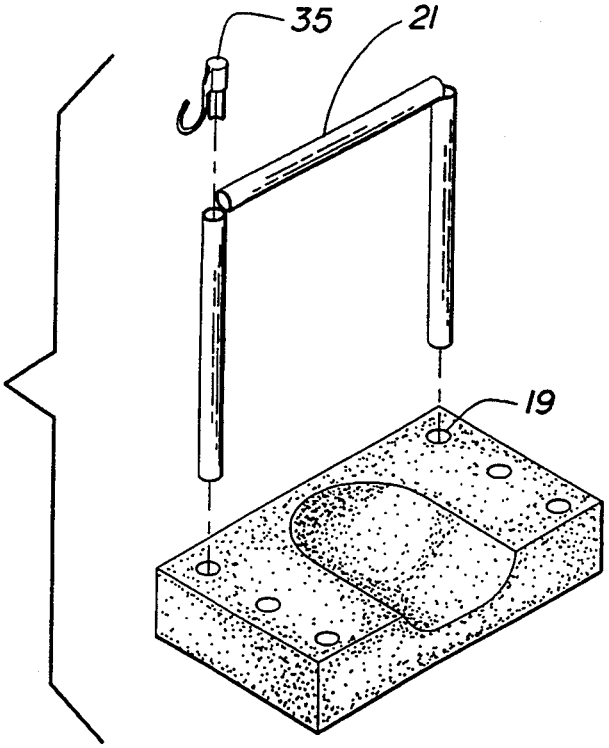
FIG. 18 is perspective view of the device shown in FIG. 17, shown exploded prior to assembly.

FIGS. 12 through 17 show an alternative embodiment that is suitable for a greater variety of uses in surgical and medical treatments. This embodiment has a foam cushion with a bottom surface 11 for engagement with the operating table. Top 15 includes a sculptured placement portion 17 for positioning the patient's head with respect to locating holes 19. As can be seen, top 15 in FIG. 17, for example, has three pairs of holes 19. The additional holes 19 allow a single pipe 21, as illustrated as being assembled in FIG. 18, to be positioned in the front, center or back pairs of holes 19.

Figure 19:
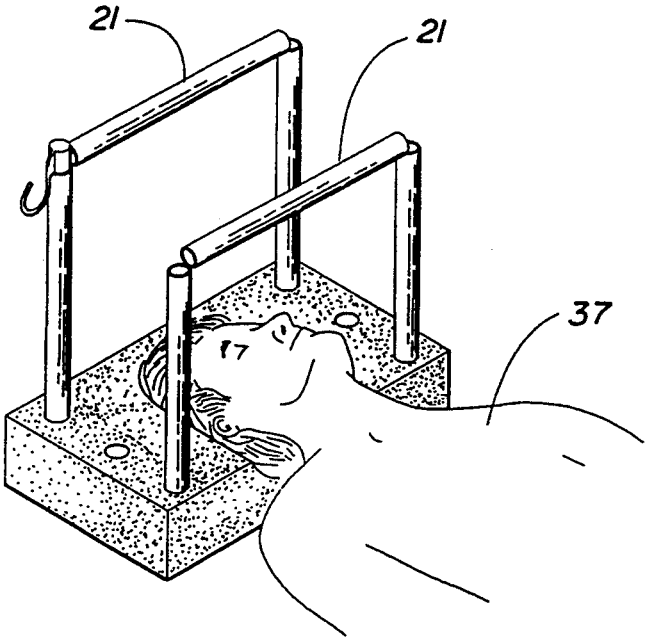
FIG. 19 is a perspective view of the device shown in FIG. 17, shown after assembly.
Figure 20:
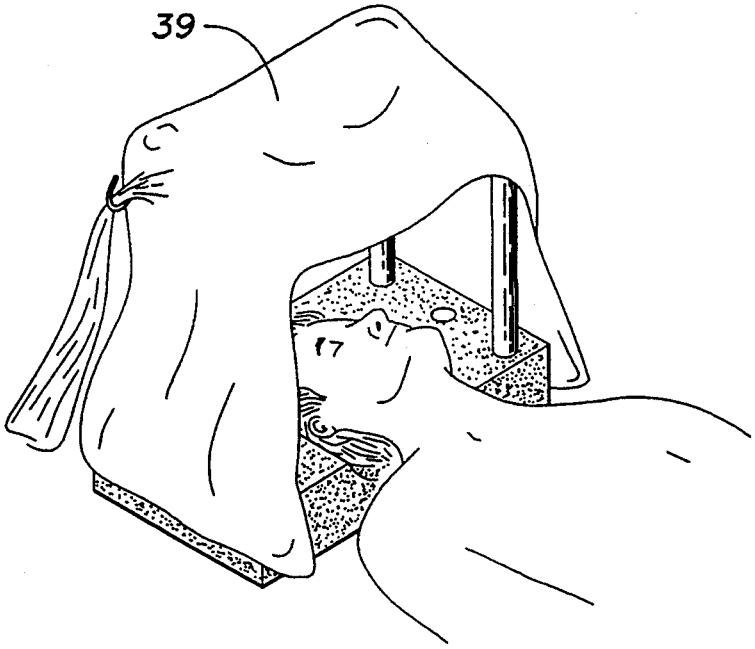
FIG. 20 is perspective view similar to FIG. 19, showing the surgical drape in place and in use with a patient.
Figure 21:
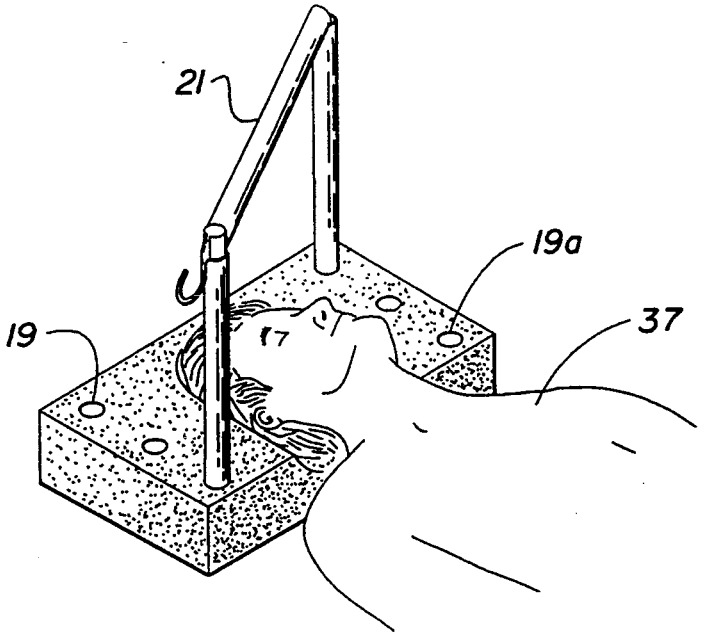
FIG. 21 is a perspective view similar to FIG. 19, showing an alternative alignment of the tube in the cushion.

Another alternative is to use a second tube 41 in combination with tube 21, shown in FIG. 19, so that more space under the surgical drape can be provided, shown in FIG. 20. Yet another alternative is shown in FIG. 21, where tube 21 reaches between hole 19 and 19*a*, from different pairs of holes to permit access to one side or the other of the patient 37 as needed. It is clear that a variety of combinations of tubes and drapes can be employed as part of the present invention.

Figure 9:
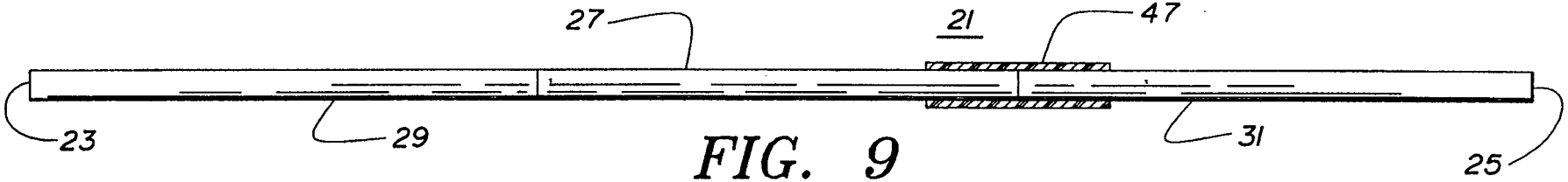
FIG. 9 is a plan view of the drape stand pipe, showing lines for cutting to form hinges.
Figure 10:
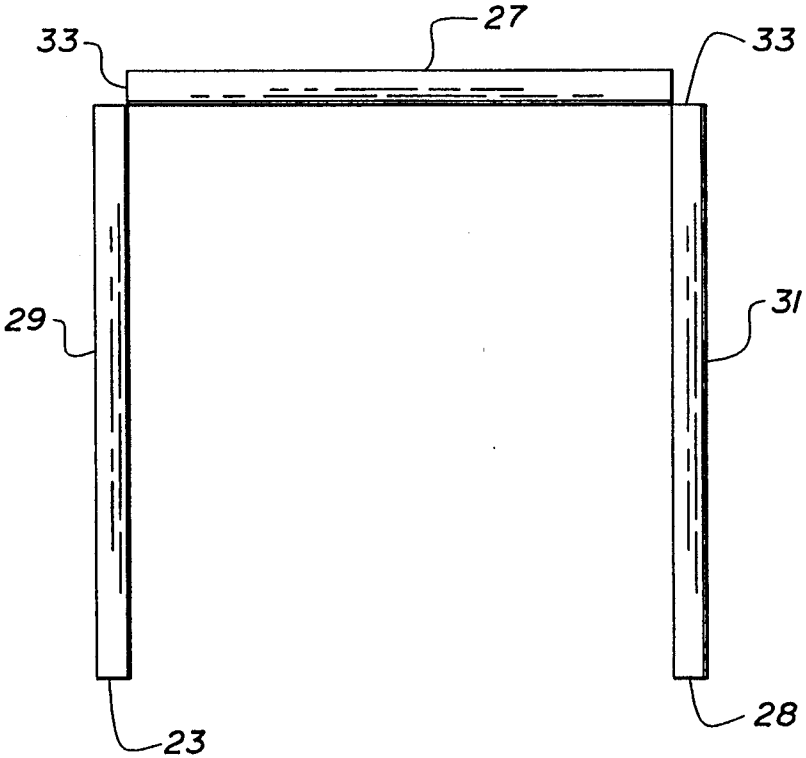
FIG. 10 is a plan view of the pipe of FIG. 9, showing the hinges after formation.
Figure 12:
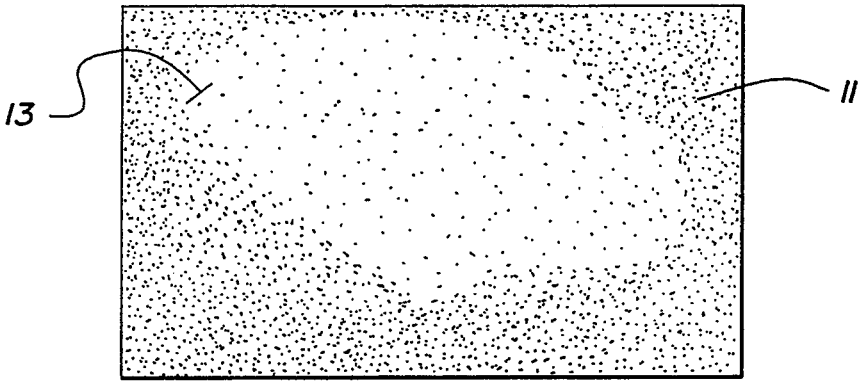
FIG. 12 is a bottom plan view of a second embodiment of the present invention.
Figure 13:
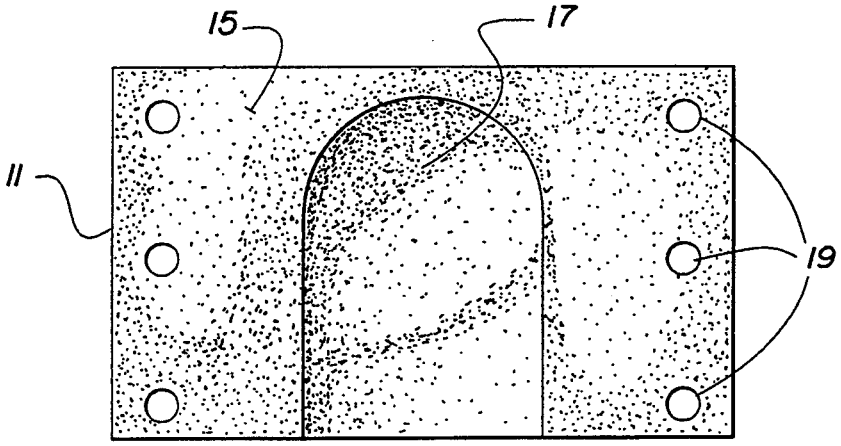
FIG. 13 is a top plan view of the device shown in FIG. 12.
Figure 14:
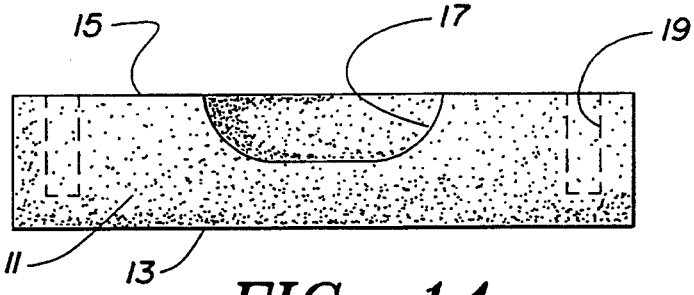
FIG. 14 is a front elevational view of the device shown in FIG. 12.
Figure 15:
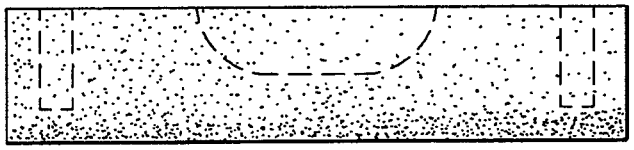
FIG. 15 is a back elevational view of the device shown in FIG. 12.
Figure 16:
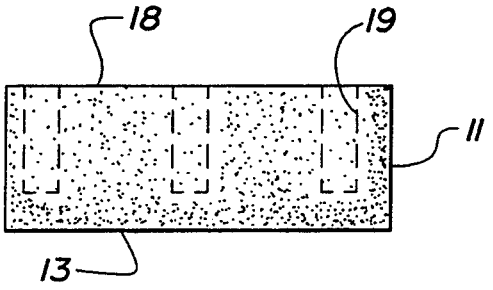
FIG. 16 is a side elevational view of the device shown in FIG. 12.
Figure 17:
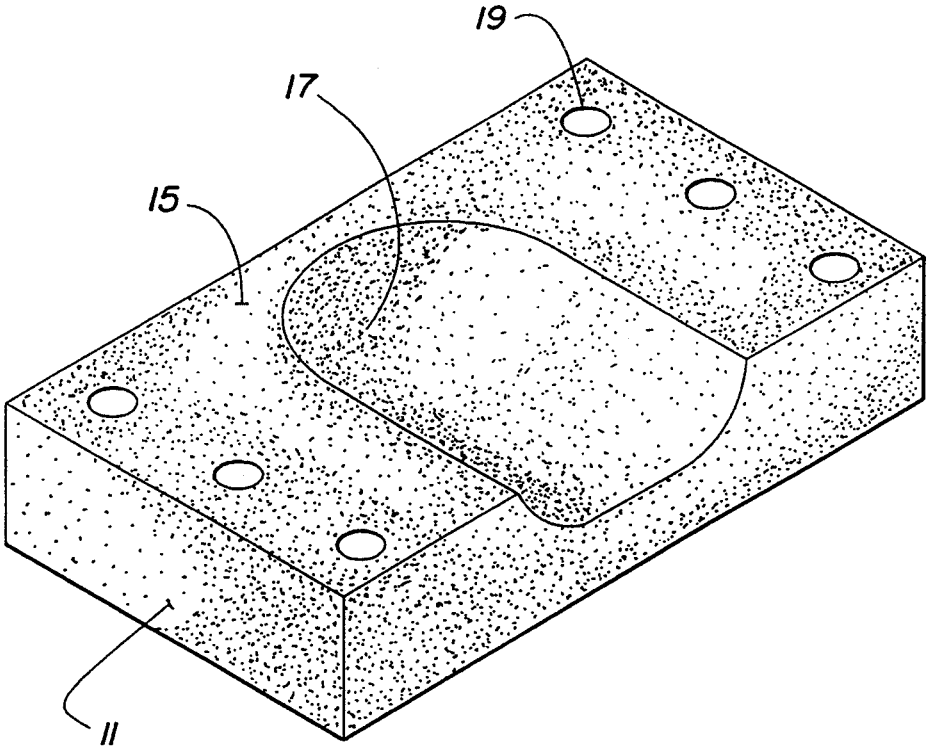
FIG. 17 is a perspective view of the device shown in FIG. 12.

In another embodiment, it has been discovered that hollow tubes or sleeves can be located over the hinges when the device is in storage to keep the tube in axial alignment. Sleeve 47 in FIG. 9 is one form of this locking means.

It has been also found that other hinges may be used, such as by way of example, mechanical hinges. While the alternative hinge may be more expensive than a simple radial cut partially through the periphery, this alternative is also contemplated.

While particular embodiments of the present invention have been illustrated and described, it is not intended to limit the invention, except as defined by the following claims.

I claim:

1. A device for use with a patient on a procedure table for locating a surgical drape, comprising:

a mobile head cushion, said head cushion being formed from a foam material cushion, said cushion having a first surface for locating said cushion on said table and a second surface including a head rest for locating a patient's head in a predetermined location, said cushion having a predetermined thickness between said surfaces and further having drape stand locating means for locating a drape stand with respect to said predetermined location comprising at least two holes in said cushion thickness, said thickness between said first and second surfaces being from about two to about eight inches; and a drape stand formed from a tube for receiving said surgical drape, said drape stand being formed from a tube having two ends for cooperative engagement with said locating means and a length equal to about twice the desired height plus the width of said stand, said locating means being the sole locating means for said tube, said tube having two hinges formed by radially cutting through from about 70% to about 98% of the periphery of said tube, each of said hinges being spaced from an end of said tube by said desired height and spaced from each other by said width.

2. The device of claim 1, wherein said drape stand locating means includes a plurality of pairs of holes sized and positioned to receive said tube ends in a plurality of operable relationships.

3. The device of claim 1, which further includes locking means for locking said tube in an axially straight orientation.

4. The device of claim 3, wherein said locking means comprises a hollow tube sized to engage the outer surface of said tube.

5. A device for use with a patient on a procedure table for locating a surgical drape, comprising:

a mobile head cushion, said head cushion being formed from a foam material cushion, said cushion having a first surface for locating said cushion on said table and a second surface including a head rest for locating a patient's head in a predetermined location, said cushion having a predetermined thickness between said surfaces and further having drape stand locating means for locating a drape stand with respect to said predetermined location comprising at least two holes in said cushion thickness, said thickness between said first and second surfaces being from about two to about eight inches; and a drape stand formed from a tube for receiving said surgical drape, said drape stand being formed from a tube having two ends for cooperative engagement with said locating means and a length equal to about twice the desired height plus the width of said stand, said locating means being the sole locating means for said tube, said tube having two hinges, each of said hinges being spaced from an end of said tube by said desired height and spaced from each other by said width.

* * * * *